United States Patent [19]

Varlonga

[11] 4,137,678

[45] Feb. 6, 1979

[54] VERTICALLY SUSPENDED FOIL STRUCTURE FOR SOUND MUFFLING AND LIGHT SCATTERING FALSE CEILINGS

[76] Inventor: Giovanni Varlonga, Piazza della Repubblica, 7, Milan, Italy

[21] Appl. No.: 807,476

[22] Filed: Jun. 17, 1977

[30] Foreign Application Priority Data

Jun. 25, 1976 [IT] Italy ..... 24755 A/76

[51] Int. Cl.[2] ..... G09F 7/18

[52] U.S. Cl. ..... 52/39; 52/144; 52/667

[58] Field of Search ..... 52/144, 676, 664, 666, 52/667, 661, 39, 28, 484, 489; 24/214, 213 R, 81 PB, 81 R; 240/9 R, 78 R, 78 LD, 108 R; 248/324, 343, 317

[56] References Cited

U.S. PATENT DOCUMENTS

| | | | |
|---|---|---|---|
| 3,193,231 | 7/1965 | Curry | 24/214 X |
| 3,624,388 | 11/1971 | Schwartz | 240/9 R X |
| 3,774,024 | 11/1973 | Deaton | 52/484 X |
| 3,798,446 | 3/1974 | Deaton | 52/28 X |
| 3,969,870 | 7/1976 | Deaton | 52/664 |

*Primary Examiner*—Price C. Faw, Jr.
*Assistant Examiner*—Carl D. Friedman
*Attorney, Agent, or Firm*—Guido Modiano; Albert Josif

[57] ABSTRACT

A vertically suspended foil structure for sound muffling and light scattering false ceilings comprises a grid of U-shaped metal crossbeams, resting on longitudinal stringers, and foils attached to one another by a crossbeam engaging device having a spring biassed head for insertion in a hole through a metal plate and a prismatic body whereto a foil is affixed rigidly, each crossbeam having holes through the upper side thereof and mating notches in its wing portions adapted to engage the head in the hole and concurrently snap engage two opposite corners of the crossbeam engaging device in the wing portions.

1 Claim, 4 Drawing Figures

VERTICALLY SUSPENDED FOIL STRUCTURE FOR SOUND MUFFLING AND LIGHT SCATTERING FALSE CEILINGS

BACKGROUND OF THE INVENTION

This invention relates to a vertically suspended foil or blade structure for sound muffling and light scattering false ceilings.

False ceilings, as formed by orderly arranged vertical foils or blades, are considered to be one of the most sophisticated solutions to the acoustical and lighting problems of large halls. In general, to suspend the foils or blades, a grid of small beams bearing on parallel stringers depending from the ceiling is employed, the foils or blades being attached with different preselected orientations to the beams, the latter being removable, e.g. for cleaning purposes, with the whole foil set attached thereto. The most critical portion of such suspending structures is the foils to beams attaching device. The foils are usually attached alternately at 90° to one another. The goal is here an easier selection of the orientation which is more suitable for an individual application, without involving adjustment operations, and moreover that the foil orientation may be changed in an easy and quick manner, with a view to achieving improved effects, or for rearranging them parallel for cleaning. Therefore, the use of screw fasteners has been entirely discarded as they require too much time for installation as well as for re-orientation of the foils or blades. Fixed hooks have instead been adopted, which may be quickly engaged and ensure automatically a preselected orientation. The main drawback of such prior art foil attaching hooks is that they do not allow for an easy re-orientation in the complementary direction, it being generally required that the hook be released and reinserted in order to change the orientation by 90°. To obviate such an inconvenience, a simple friction pivotable hook has been proposed which may be rotated to take any orientation, but this requires the foils to be aligned individually, either by eye or any reference means, every time the foils or blades are to be cleaned.

SUMMARY OF THE INVENTION

In view of the above, it is a general object of this invention to eliminate the cited prior art drawbacks in the installation of foil type false ceilings.

More specifically, it is a primary object of the invention to provide an attaching device for suspending foils or blades to respective beams in false ceilings, which may be easily hooked up and oriented by snap action in predetermined directions.

These and other objects, such as will be apparent hereinafter, are achieved by a vertically suspended foil or blade structure for sound muffling and light scattering false ceilings, (according to the invention), comprising a grid of crossbeams resting on longitudinal stringers supported by the bearing slab of the ceiling, and foils or blades being attached to one another at an angle by means of a crossbeam engaging device, characterized in that said crossbeam engaging device has a spring biased head adapted for insertion and retention in a hole through a metal plate and a prismatic body whereto a foil or blade is affixed rigidly, and that each crossbeam is a channel sectional member made of sheet metal and arranged upside down and having holes through the upper side thereof and mating notches in the wing portions of said channel sectional member adapted to engage the device head in the hole and concurrently snap engage two opposite corners of said device in said notches in the wing portions of the crossbeam channel sectional member.

BRIEF DESCRIPTION OF THE DRAWINGS

The invention features and advantages will become more apparent from the following detailed description of a preferred but not restrictive embodiment thereof, given herein by way of explanation and example only and illustrated in the accompanying drawing, where.

DESCRIPTION OF THE PREFERRED EMBODIMENTS

Figure 1:
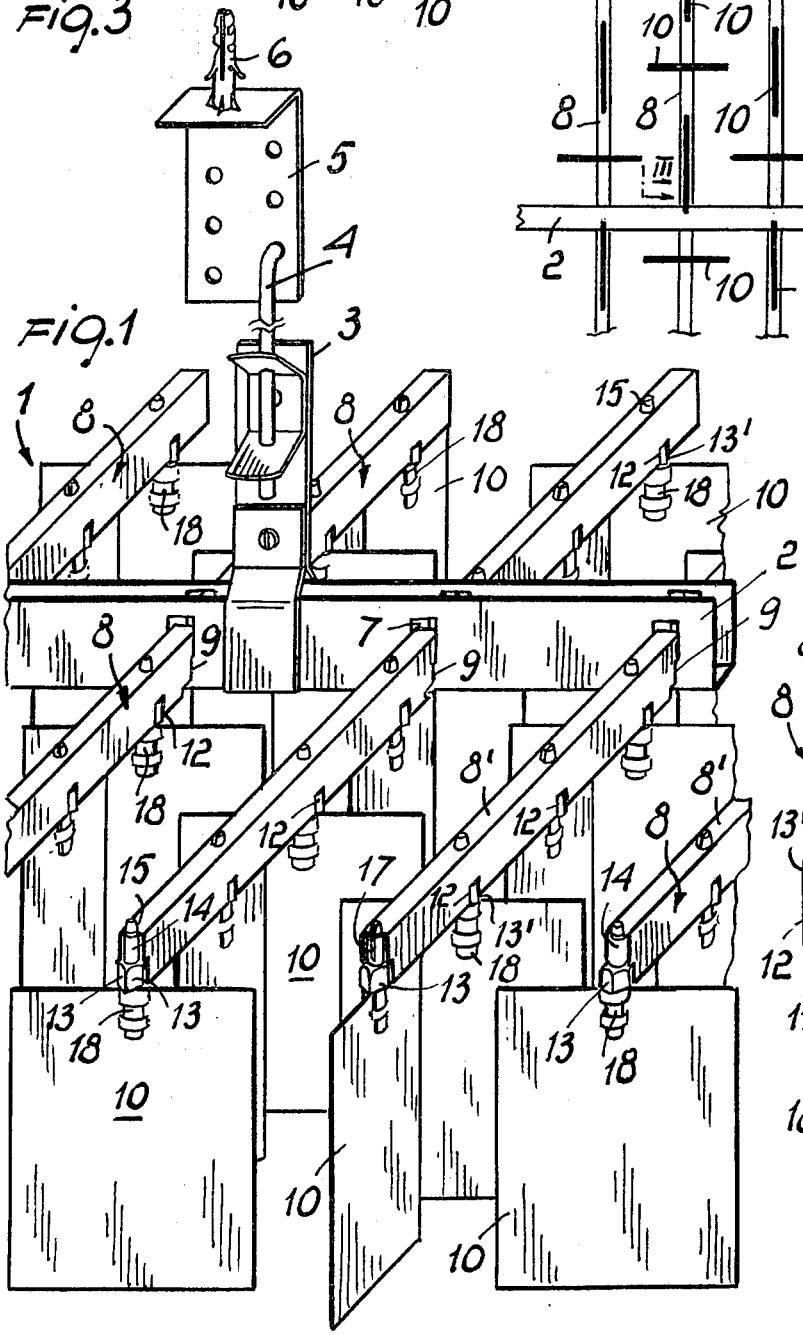
FIG. 1 is a perspective view from above of a false ceiling structure according to the invention.

With reference first to FIG. 1, a false ceiling structure according to the invention is generally indicated at 1, a significant portion of the structure being shown which is modularly repeated throughout. The reference numeral 2 denotes a longitudinal stringer which is suspended from the bearing slab of the ceiling, not shown, by means of an assembly including a suspension bracket 3 for the stringer, a tie 4, and a plate 5 attached to the ceiling by means of an expansion insert 6 or the like.

On the longitudinal stringer 2, which is a channel sectional member wherethrough apertures 7 are cut in paired relationship on both sides, i.e. facing each other and at regular intervals apart, crossbeams 8 are made to rest. Such crossbeams are inserted, in jointed engagement, through an aperture 7 with one end, the lower edge of the aperture being engaged in a slot. Each crossbeam supports a plurality of vertical foils or blades 10, which are spaced apart uniformly and alternately arranged in parallel or perpendicular planes to the crossbeam axis. Each foil is attached to the crossbeam by means of a device 11, which will be explained hereinafter. Stop or retention notches 12 may be observed in the crossbeams, and are effective to engage with the hooking devices 11.

Figure 3:
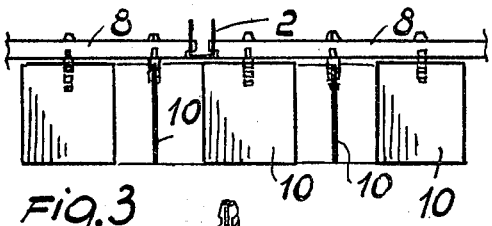
FIG. 3 is a sectional view taken along the line III—III of FIG. 2.
Figure 2:
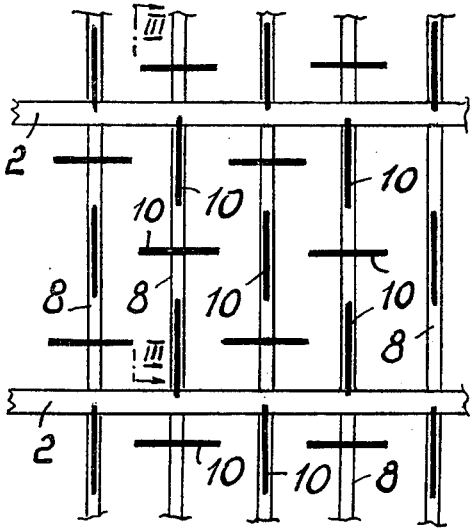
FIG. 2 is a plan view of the arrangement proposed for the foils or blades.

The foil arrangement is shown in a schematical or geometric way in FIGS. 2 and 3, where neither the relative proportions nor the number of foils per crossbeam are the actual ones. The arrangement shown is, as mentioned above, an orthogonal one of Cartesian configuration, with the foil planes alternately parallel to the crossbeams and stringers. However, other arrangements are easily implemented in the instant invention, such as for example with the foils again orthogonal to one another but at 45° to the crossbeam axes, or in accordance with non-orthogonal layouts, such as a honeycomb arrangement with the foils at 60° to one another. The invention affords the further benefit of being adaptable to any selected practical layout, and in some cases it is obviously convertible from one layout to another.

Figure 4:
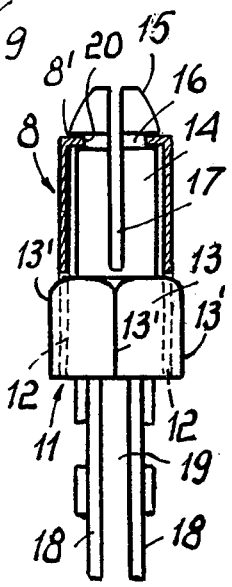
FIG. 4 is an elevational view showing in detail the instant crossbeam engaging or hooking device, being represented in its inserted position on a cross-sectioned crossbeam.

The details of the engaging or hooking device, which characterize this invention together with seats provided therefor in the crossbeam, are visible in FIG. 4. The crossbeam engaging device or hooking device 11 comprises a square prismatic or faceted base body 13, wherefrom extends a cylindrical portion 14 terminating in an insertion head 15 connected to the cylindrical portion through a circumferential groove formation 16. The head, groove and cylindrical portion are all split longitudinally by an axial cut 17 affording a spring bias similar in concept to that of an electric tap. Downwardly, with respect to the installed position depicted in the drawing, there is projecting from the square prism or base 13 a bifurcated tail piece comprising two shaped stems 18 which are separated from each other by a cut 19 the depth whereof extends to the base 13. Through that cut, a foil or blade 10 is pressed and retained by conventional mechanical means. The device 11 is accomodated within the channel or "U" of a section shaped crossbeam 8, with its head inserted through and beyond a hole 20 formed in the upper side or web 8' of the crossbeam, in force fit engagement, the groove 16 being joint engaged with the edge of the hole 20. As visible from the drawing the channel section shaped cross-beam 8 is arranged with its wing portions directed downwards, so that the gap between the wings is downwardly open. Upon insertion, two opposite edges or corners 13' and 13' of the prismatic or faceted base are pressed in two notches 12, as mentioned above, in the wings of the channel sectional member, thus effecting a snap action type of geometric retention. Therefore, if like in the drawing the base has a square cross-sectional configuration, then only two fixed positions at 90° to each other are available, plus two reversed ones which are reached and maintained by snap action. Thus it will be sufficient for the foil installer to insert them in the approximate desired direction, the notches automatically guiding them in the exact wanted direction.

This useful result is accomplished by the combination of a freely pivotable circular retention hook consisting of the circumferential groove 16 engaging the hole 20 and the notches 12 snap engaging the edges or corners 13' of the base 13.

In FIG. 4, such notches are exemplarly represented by cutouts, whereas in FIG. 1 they are outwardly projecting V-like dimples. It will be apparent that the shape of the notch has no restrictive effect on the invention, the significant aspect thereof being the snap type of positioning action which said notches or dimples afford. Carried to extremes, said dimple might also project inwardly and the base be of circular cross-section with corresponding grooves adapted to accomodate said dimples with a snap movement. In this manner, a change of orientation of all or part of the foils, e.g. prior to their cleaning and afterwards, on re-installation, becomes an extremely easy and quickly carried out operation, and it might be possible, if desired, to transmit such a change to a whole foil row by simply having all the foils in one crossbeam interconnected by a wire or string such as to rotate unitedly.

While one embodiment of the invention has been disclosed herein, it will be obvious that the scope thereof is not restricted to such an embodiment but rather includes any variations and modifications of the invention which embody the inventive concepts herein taught and claimed in the appended claims.

I claim:

1. A vertically suspended foil or blade structure for sound muffling and light scattering false ceilings, comprising a grid of crossbeams resting on longitudinal stringers and foils or blades attached on the crossbeams at an angle to one another by means of a crossbeam engaging device, wherein said crossbeam engaging device has a spring biased head adapted for insertion and retention in a hole through a wall of the crossbeam and a faceted body whereto a foil or blade is affixed rigidly, said faceted body having plane surfaces at an angle to each other and forming at least two opposite corners thereon, and wherein each crossbeam is a channel sectional member made of sheet metal, said channel section having a pair of spaced apart parallel wing portions forming a gap therebetween and a web portion connecting bridge-like said wing portions, said wing portions having their free longitudinal edges facing downwardly thereby said gap having its longitudinal opening facing downwardly, said web portion having holes provided at regular intervals therethrough and said wing portions having notches in alignment with said holes adapted to engage said head in the hole and concurrently snap engage said two opposite corners of said device in said notches in the wing portions of the crossbeam channel sectional member, and wherein in said crossbeam engaging device the insertable head is split lengthwise to provide spring bias thereof and wherein said crossbeam engaging device has a circumferential groove between the head and the faceted body thereof, to allow for retention and rotation thereof when engaged in said hole and wherein pairs of said opposite corners of the faceted body for snap engagement with the crossbeam notches are arranged in planes forming mutual angles which are equal to the mutual angles formed by said foils or blades.

* * * * *